United States Patent [19]

Hatakeyama et al.

[11] Patent Number: 4,589,429

[45] Date of Patent: May 20, 1986

[54] VANITY CASE

[75] Inventors: Yoshiharu Hatakeyama, Tokyo; Kenzo Teshima, Chiba, both of Japan

[73] Assignee: Yoshida Industry Co., Ltd., Tokyo, Japan

[21] Appl. No.: 668,554

[22] Filed: Nov. 2, 1984

[30] Foreign Application Priority Data

Nov. 7, 1983 [JP] Japan ..... 58-171338[U]

[51] Int. Cl.[4] ..... A45D 33/00

[52] U.S. Cl. ..... 132/79 R; 132/83 R

[58] Field of Search ..... 132/83 R, 82, 79

[56] References Cited

U.S. PATENT DOCUMENTS 1,694,702 12/1928 Deitel ..... 132/83 R 1,955,835 4/1934 Samstag ..... 132/82 R

*Primary Examiner*—Gregory E. McNeill

*Attorney, Agent, or Firm*—Wenderoth, Lind & Ponack

[57] ABSTRACT

A vanity case includes a cover and a receptacle openably hinged together and formed of synthetic resin by molding. Provided on the outer surface of each of the cover and receptacle is at least one ornamental metallic band. Each band is integrally attached to the cover or receptacle by insert molding, with side portions of each band bent or folded downwardly to form generally a U-shape in section. The side portions are embedded in the synthetic resin forming the cover and receptacle, with the outer surfaces of the central portions thereof being exposed to extend outwardly from the surfaces of the cover and receptacle.

6 Claims, 8 Drawing Figures

VANITY CASE

BACKGROUND OF THE INVENTION

This invention relates to a vanity case for cosmetics and more particularly to a vanity case made of synthetic resin and provided with ornamental metallic bands thereon.

As known, a vanity case such as a compact comprises a receptacle and cover openably hinged together. The cover is constituted in such a manner as to be maintained in a closed state with respect to the receptacle by resilient means such as a hook portion and to be readily opened by applying a certain amount of force. A mirror is fixed to an inner surface of the cover and a solid or viscous cosmetic material is contained in an inside cavity of the receptacle.

The above type of vanity case is an accessory carried by women. Therefore, an elegant and high-grade appearance is required. Such containers are mostly made of synthetic resin and a few are made of metal. A metallic container is often complex in construction, particularly in its hinge and hook portions, and not only does it require a large number of parts, but also the working processes thereof are highly complicated, thereby resulting in high costs. On the other hand, a metallic container offers an attractive and tasteful appearance inherent to metallic material, although it is heavy to carry. Because of the foregoing, metallic material is used, but only for an extremely limited range of high-class containers.

It is one of the remarkable features of vanity cases made of synthetic resin that they can be manufactured in an extremely simple manner and at low cost by means of molding operations. On the other hand, a fancy and attractive appearance is difficult to obtain, and various decorating means have been contemplated in order to overcome this weak point.

Hot-stamp and print devices have been most commonly used as decorations. However, such arrangements have the disadvantages that the decorated surfaces through such means are readily subjected to physical and chemical deterioration and that the portions decorated by means of hot-stamping or printing are readily removable or changed in quality. Moreover, it is difficult to produce by such devices as an attractive appearance as that of a metallic container.

Although the outer surface of the synthetic resin container can be treated with vacuum plating, electroplating, etc., partial plating is unavailable. Besides, various surface processes which are available for a metal surface are difficult to employ on a plating layer. Consequently, the ornamental surface by this means is no more than plain and uniform, since the treatment must be provided either on the overall surface, or on the exposed surfaces of the parts.

Also it is known to attach a metallic plate to the surface of a synthetic container for decorating purposes. In a conventional vanity case of this type, a metallic plate is attached to the entire surface, or only to a central portion thereof, by means of adhesive agent. In this case, the edge portions of such metallic plate are exposed outwardly. As a result, the thickness of the metallic plate is readily known, thus rendering impossible the creation of an attractive and high-grade appearance. Futhermore, the metallic plate attached to the surface by means of an adhesive agent tends to come off comparatively easily around its edge portions. Even if it does not come off completely, a possible gap formed around the marginal or edge portions will degrade the appearance considerably. In order to avoid such phenomenon, some prior art arrangements attempted to form a one-pointed ornament by attaching a small metal of a square or round shape to the surface, and others tried to cover the entire surface with a metallic plate. However, an ornament obtained through such methods is plain and does not provide a stereoscopic impression.

The present invention was accomplished in view of the above.

SUMMARY OF THE INVENTION

It is therefore a general object of the present invention to provide a vanity case made of synthetic resin and provided with band-shaped metallic plates for ornamental purposes to produce attractive and high-grade appearance.

Another object of the present invention is to provide a vanity case which can offer an appearance abundant in ornamental variety.

A further object of the invention is to provide a vanity case which has a stereoscopic appearance.

Still a further object of the invention is to provide a vanity case on the surface of which is an ornamental portion which is surely prevented from being removed.

To achieve the above and other objects, there is provided a vanity case comprising a cover, a receptacle openably hinged to the cover, the cover and receptacle forming a container body made of synthetic resin by means of molding, and at least one ornamental metallic band provided on the outer surface of the container body. The bands are integrally attached to the container body by means of an insert molding operation, whereby each band is folded downwardly at opposite sides thereof to form generally a reversed U-shape in section, with the sides being embeded in the synthetic resin material forming the container body, and with the main portions between the sides being exposed in such a manner as to extend outwardly from the outer surface of the container body.

Many other advantages and features of the present invention will become manifest to those versed in the art upon making reference to the following description and the accompanying drawings in which preferred structural embodiments incorporating the principles of the present invention are shown by way of example.

DETAILED DESCRIPTION OF THE INVENTION

Preferred embodiments of the present invention will be described hereunder with reference to the accompanying drawings.

Figure 1:
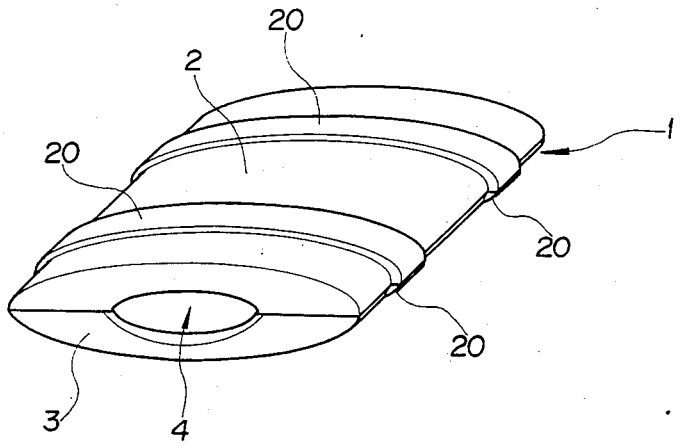
FIG. 1 is a perspective view of a vanity case according to one embodiment of the present invention.
Figure 2:
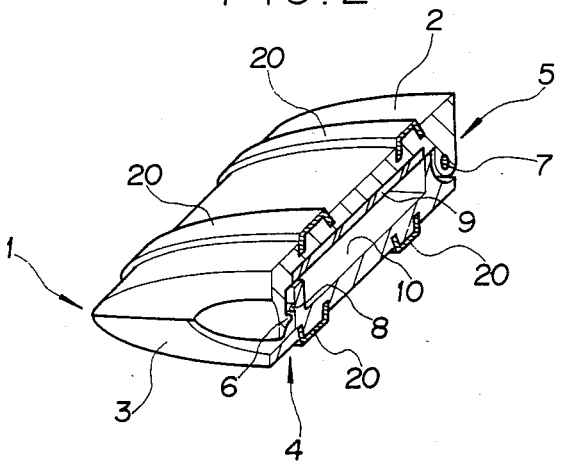
FIG. 2 is a vertical sectional perspective view of the vanity case in FIG. 1.

In FIGS. 1 and 2, a container body 1 generally comprises a cover 2 and a receptacle 3. The cover 2 which is generally symmetric with the receptacle 3 is openably coupled therewith by a pin 7 at a hinge portion 5. At a hook portion 4 opposite to the hinge portion 5, a projection 6 formed on the cover 2 is resiliently engaged with a projection 8 formed on the receptacle 3. The arrangement is such that when the cover 2 and receptacle 3 are shut by a force more than a certain degree, they are maintained in a closed state due to mutual engagement of the projections 6 and 8. On the other hand, when the cover 2 and receptacle 3 are opened by a force more than a certain degree, the projections 6 and 8 are disengaged from each other, thereby enabling the cover 2 to be opened.

A mirror 9 is fixed to an inner surface of the cover 2 and a recess formed inside of the receptacle 3 serves as a cavity 10 for containing cosmetic material therein. The cover 2 and receptacle 3 of the container body 1 are respectively provided on the outer surfaces thereof with two ornamental metallic bands 20 according to the present invention. When viewed totally, the bands 20 are formed generally in arcuate shapes complementary to the configurations of the curved outer surfaces of the cover 2 and receptacle 3. In the closed state, the cover 2 and receptacle 3 offer an outer appearance as if metallic bands 20 were wound around the entire peripheries thereof at two portions thereof.

Figure 3:
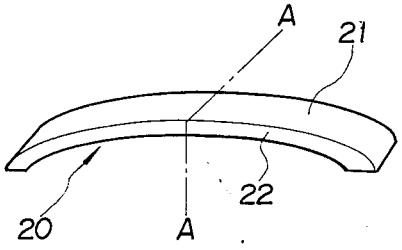
FIG. 3 is a perspective view showing an ornamental metallic band for the above vanity case.
Figure 4:
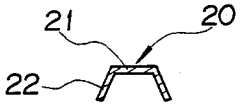
FIG. 4 is a cross sectional view taken on line A—A of FIG. 3.

Shown in FIGS. 3 and 4 is one of the ornamental metallic bands 20 which is formed by pressing a band-shaped metallic plate. The band 20 is warped or being along its entire length generally in an arcuate shape, as mentioned above, and also is folded downwardly at both sides to form generally an inverted U-shape in section. Hereinafter, the folded or bent side portions will be referred to as folded side pieces or portions 22, and the portion corresponding to the ceiling or upper web portion will be referred to as a main surface or portion 21.

The cover 2 and receptacle 3 are formed of synthetic resin by means of injection molding, and during molding the ornamental metallic bands 20 are set in cavities of the molds molds to perform a so-called insert molding operation. Within the cavities of the molds are defined concave grooves for positioning the bands 20. The depth of each of the grooves is arranged to be equal to the height of each of the ornamental metallic bands 20 which is to extend outwardly from the outer surface of the container, but less than the height of each of the folded side pieces 22. As a result, when insert molding is effected in the state where the bands 20 are set in the concave grooves, the folded side pieces of the metallic bands 20 are buried in the synthetic resin material forming cover 2 and receptacle 3, and the main surface 21 extend outwardly from the outer surfaces of the cover 2 and receptacle 3.

Consequently, the marginal or edge portions of the ornamental metallic bands 20 are not exposed outwardly. Because of the foregoing, the thickness of the bands 20 can not be recognized or determined from the outside. Therefore, the outer surfaces of portions 21 extending outwardly from the outer surfaces of the container may offer an attractive and deep impression and create a stereoscopic image as if the metallic bands 20 had considerable thickness. Also, since the folded side pieces 22 are embedded in the synthetic resin material, the ornamental metallic bands 20 are not easily removed, nor will gaps form as in the prior art. Since there is no worry about removal of the ornamentation, the outer surface of each of the bands 20 can take various shapes.

Furthermore, the metallic band 20, particularly the outer surface of portion 21, can be given various surface treatments in order to produce a variety desirable appearances or ornamentations. As means for decorating metal, there are known such as, for example, alumite processing, spin processing, diamond cutting sand blasting, mask printing, etching and the like.

Figure 5:
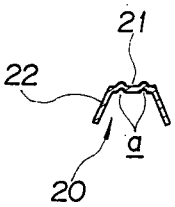
FIGS. 5 through 8 are sectional views showing several modifications of ornamental metallic bands.
Figure 6:
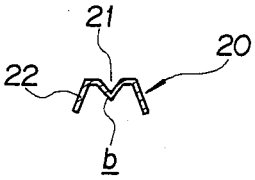

Furthermore, the outer surface of portion 21 of the ornamental metallic band 20 may be given uneven treatments as shown, for example, in FIGS. 5 and 6. According to the example shown in FIG. 5, the outer surface of surface 21 is formed with two small ridges a, a extending generally parallel with respect to each other in the longitudinal direction of the band. On the other hand, according to the example shown in FIG. 6, the outer surface of portion 21 is likewise formed with a V-shaped groove b. Such uneven treatments can be formed integrally by means of press. Alternatively, such uneven treatments can be formed during the afore-mentioned insert molding operation. That is, the molds for insert molding are formed in advance with convex and concave portions corresponding to ridges a and V-shaped groove b in the concave groove for positioning the ornamental metallic band 20, and the uneven treatment can be imparted to the metallic band 20 by utilizing supply pressure of the resin during the injection molding operation. In this case, it is preferable to select a metallic material which will be readily deformed plastically and which is as thin as about 0.3 mm in thickness.

Figure 7:
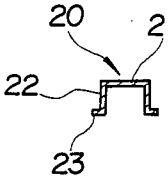
Figure 8:
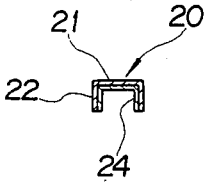

FIGS. 7 and 8 illustrate means for more effectively preventing the band 20 from being removed. In FIG. 7, the folded side pieces 22 are further folded outwardly at the lower end portions thereof to form horizontally extended flanges 23 which are embedded in the synthetic resin material together with the folded side pieces 22, thereby producing an anchor effect. On the other hand, according to the example shown in FIG. 8, there is provided in advance a heat-sensitive adhesive agent 24 or a non-woven cloth having a heat-sensitive adhesive property at the inner side of the ornamental metallic band 20, so that the heat-sensitive adhesive agent will be melted by the heat of the resin during the insert molding operation, thereby producing an adhesive effect for further strengthening the integral relation between the ornamental metallic band 20 and the cover 2 or receptacle 3.

As described in the foregoing, according to the vanity case of the present invention, fancy and attractive outer appearances can be obtained through a combination of the synthetic resin container body and ornamental metallic bands. Especially, since the marginal or edge portions of the metallic bands cannot be recognized from the outside and the bands cannot be readily removed, the ornamental effect inherent to mental can be achieved thus offering a deep and novel appearance.

Having thus described the preferred embodiments of the present invention, it should be understood that numerous structural modifications and adaptations may be restorted to without departing from the spirit of the present invention.

What is claimed is:

1. A vanity case comprising:

a cover;

a receptacle openably hinged to said cover, said cover and said receptacle together forming a container body formed of molded synthetic resin material; and at least one ornamental metallic band provided on the outer surface of said container body, said band having a generally U-shaped cross section defined by a main portion and a pair of side portions extending downwardly from opposite longitudinal edges of said main portion, said band being integrally attached to said container body by partly embedding said side portions in the synthetic resin material forming said container body when said container body is molded, and said main portion being exposed and projecting outwardly from said outer surface of said container body by the remaining of said side portions.

2. A vanity case as claimed in claim 1, wherein said main portion of said band is substantially flat.

3. A vanity case as claimed in claim 1, wherein said main portion of said band has a substantially V-shaped cross section.

4. A vanity case as claimed in claim 1, wherein said portion of said band is formed with two ridges generally parallel with respect to each other and extending in the longitudinal direction of said band.

5. A vanity case as claimed in claim 1, wherein each said side portion of said band includes at an inner end thereof an outwardly projecting flange.

6. A vanity case as claimed in claim 1, wherein said band is provided on the inner surface thereof with heat-sensitive adhesive material.

* * * * *